US006217944B1

(12) United States Patent
Yoshida et al.

(10) Patent No.: US 6,217,944 B1
(45) Date of Patent: Apr. 17, 2001

(54) AUTOMATIC COATING METHOD AND APPARATUS

(75) Inventors: Osamu Yoshida; Hidetsugu Matsuda, both of Tokyo (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 09/341,127

(22) PCT Filed: Nov. 10, 1998

(86) PCT No.: PCT/JP98/05053

§ 371 Date: Jul. 12, 1999

§ 102(e) Date: Jul. 12, 1999

(87) PCT Pub. No.: WO99/24172

PCT Pub. Date: May 20, 1999

(30) Foreign Application Priority Data

Nov. 12, 1997 (JP) ..... 9-327112

(51) Int. Cl.[7] ..... B05B 15/02; B05D 1/02; B08B 3/04

(52) U.S. Cl. ..... 427/401; 427/421; 427/444; 118/302; 118/323; 118/326; 134/38; 134/167 R; 239/106; 239/112; 239/121

(58) Field of Search ..... 427/421, 444, 427/401; 118/302, 323, 326; 134/38, 167 R, 166 R; 239/104, 106, 112, 121

(56) References Cited

U.S. PATENT DOCUMENTS 4,359,189 * 11/1982 Kroll et al. ..... 239/121
4,447,008 * 5/1984 Allen ..... 239/214.13
5,122,192 * 6/1992 Inukai et al. ..... 134/37
5,676,756 * 10/1997 Murate et al. ..... 118/629
5,679,408 * 10/1997 Eronen ..... 427/424

FOREIGN PATENT DOCUMENTS 61-121967 U 8/1986 (JP) .
62-55902 B2 11/1987 (JP) .
1-57623 B2 12/1989 (JP) .
1-57623 * 12/1989 (JP) .
2-056266 2/1990 (JP) .
2-56266 * 2/1990 (JP) .
2-068162 3/1990 (JP) .
2-37766 3/1990 (JP) .
6-134354 5/1994 (JP) .
6-269702 9/1994 (JP) .

* cited by examiner

*Primary Examiner*—Timothy Meeks
*Assistant Examiner*—Michael Barr
(74) *Attorney, Agent, or Firm*—Oblon, Spivak, McClelland, Maier & Neustadt, P.C.

(57) ABSTRACT

An automatic coating apparatus. A rotary atomizing head is washed with the fluid supplied from its front side by a washing nozzle. A coating machine is mounted on a coating robot for moving in arbitrary directions, while an atomizing head washer is located in the vicinity of the coating robot. At the time of a washing operation, the coating robot is actuated to put the rotary atomizing head into a waste liquid collecting container of the atomizing head washer. In this state, thinner is discharged from the washing nozzle toward the front side of the hub member of the rotary atomizing head. Thinner is then allowed to flow into the rotary atomizing head through solvent outlet holes in the hub member to wash off deposited paint from the rotary atomizing head.

8 Claims, 6 Drawing Sheets

AUTOMATIC COATING METHOD AND APPARATUS

BACKGROUND OF THE INVENTION

1. Field of the Invention

This invention relates to an automatic coating method and an automatic coating system therefor, using a coating machine particularly suitable for use in coating of vehicle bodies or other articles which involve changes of paint colors.

2. Discussion of the Background

Generally speaking, prior art automatic coating systems are largely constituted by a working mechanism which is located in a predetermined coating area like a coating booth, and a coating machine which is mounted on the working mechanism and provided with a rotary atomizing head to be put in high speed rotation for spraying a paint in the form of finely atomized particles.

The coating machine which are used in the coating system of this sort are largely constituted by an air motor which is mounted within a housing, a hollow cylindrical rotational shaft which is passed axially through the air motor and put in high speed rotation by the air motor, a feed tube which is extended axially and internally through the rotational shaft to supply a paint or a wash fluid, and a rotary atomizing head which is mounted on and at the fore end of the rotational shaft and provided with paint releasing edges on the outer peripheral side thereof.

In this connection, there has been known a feed tube of the construction as described in Japanese Utility Model Laid-Open No. H2-37766. This feed tube is formed in the shape of a double wall tube providing a paint passage internally of an inner tube and a front end washing thinner passage between inner and outer tubes. The paint passage of the feed tube is connected to a color changing valve apparatus, while the thinner passage is connected to a thinner source through a thinner pipe. Thinner is spurted out through the front end washing thinner passage whenever it becomes necessary to wash off deposited paint from the outer periphery of a front end portion of the feed tube. Further, through a drain valve which is constituted by a three-way valve, one end of a waste liquid drain passage is connected to a joint portion of the paint passage of the feed tube with the afore-mentioned paint pipe. The other end of the waste liquid drain passage is connected to a waste tank.

In this instance, the coating machine is mounted on a working mechanism such as a coating robot, reciprocator or the like for a paint coating operation while keeping a predetermined distance from a vehicle body or an object to be coated. At the same time, paint is sprayed by the coating machine toward a coating object (e.g., a vehicle body) for coating the paint thereon.

Namely, while the coating machine is moved by the working mechanism, the rotary atomizing head is put in high speed rotation by the air motor. In this state, a paint from a color changing valve apparatus is supplied to the rotary atomizing head through the paint passage of the feed tube. The supplied paint is released in the form of atomized particles at paint releasing edges of the rotary atomizing head which is kept in high speed rotation. Since a high voltage is applied to the rotary atomizing head, the paint is sprayed as charged particles from the paint releasing edges of the rotary atomizing head, and urged to fly toward and deposit on the coating object under the influence of an electrostatic field which is formed between the rotary atomizing head and the coating object which is connected to earth. The coating system includes controls for the coating machine and the working mechanism to carry out a coating operation on the coating object automatically.

When changing the paint color, a previous color which remains in the paint pipe is washed away before supplying a fresh color thereto. In a washing stage, the drain valve is opened in the first place to secure a route from the paint feed pipe to the waste tank through the waste liquid drain passage. Then, thinner and air are alternately supplied from the color changing valve apparatus to clean the paint pipe.

In the next place, thinner is supplied again from the color changing valve apparatus to wash the paint passage in the feed tube and the rotary atomizing head. This thinner is flushed toward the rotary atomizing head through the paint pipe and the feed tube, thereby washing the paint passage as well as the rotary atomizing head.

Further, from a front washing thinner source which is provided separately from the color changing valve apparatus, thinner is supplied to the outer periphery of a fore end portion of the feed tube via thinner pipe, front washing valve and front washing thinner passage of the feed tube to wash spot-wise the outer periphery of a fore end portion of the feed tube. Thereafter, paint of a fresh color is supplied to the paint passage in the feed tube from the color changing valve apparatus in preparation for a coating operation for the new color.

Thus, according to the paint sprayer machine which is disclosed in Japanese Utility Model Laid-Open No. H2-37766, the paint pipe between the rotary atomizing head and the color changing valve apparatus as well as the rotary atomizing head and the outer periphery of a fore end portion of the feed tube have to be washed each time before changing the paint color. A washing operation of this sort not only takes a long time but also invites a conspicuous increase in running cost due to large consumption of thinner or wash fluid.

Attempts have been made to develop a coating machine which can overcome these problems, as disclosed in Japanese Patent Laid-Open No. H6-134354 and H6-269702. The prior art coating machines described in these publications are of the type which uses a bundle of feed tubes for feeding various paint colors separately from the respective paint sources through the respective paint pipes, paint valves and paint feed tubes.

In the case of the coating machines of the bundled feed tube type, having a bundle of feed tubes including a plural number of paint feed tubes for different paint colors and a wash feed tube which is connected to a thinner source through a thinner feed pipe having a wash valve connected within the length thereof.

According to the prior art coating machines of the type just mentioned, the each one of the bundled paint feed tubes is connected to a paint supply source of a specific color through a paint feed pipe and a paint valve which is provided within the length of the paint feed pipe. The paint which is supplied to a rotary atomizing head through one of the bundled feed tubes is released in the from of atomized paint particles from the rotary atomizing head which is put in high speed rotation. Since a high voltage is applied to the rotary atomizing head, the released paint particles are thereby charged and caused to fly toward and deposit on a coating object which is connected to earth.

On the other hand, when changing the paint color, a wash fluid like thinner is fed to the rotary atomizing head through a wash feed tube for washing away blots of previous color from the rotary atomizing head.

In the case of the coating machine as described in the above-mentioned Japanese Utility Model Laid-Open No. H2-37766 having a double-wall feed tube, there is an inherent problem that the machine construction is complicated due to the necessity for connecting the washing thinner passage of the feed tube to a washing thinner source through a thinner pipe separately from the color changing valve apparatus.

Similarly, the machine construction is complicated in the coating machines disclosed in Japanese Patent Laid-Open No. H6-134354 and H6-269702 which require to connect a wash feed tube in the bundle of feed tubes to a thinner source through a thinner feed pipe separately from other paint feed tubes which are allocated to different colors.

Further, each one of the above-mentioned prior art coating machines has a problem in that, when washing a rotary atomizing head, a coating area is contaminated considerably by paint and thinner which are scattered around when released from the rotary atomizing head.

Furthermore, in any of the above-mentioned prior art coating machines having a wash thinner passage (or a wash feed tube) located on a coating machine body, there is a possibility of an applied high voltage flowing toward the thinner source through the thinner in the wash thinner passage (or a wash feed tube). Therefore, the thinner to be used for a washing operation is required to maintain a certain level of electrical resistivity and in a large quantity because it cannot be selected from inexpensive products simply in consideration of washing capacity.

SUMMARY OF THE INVENTION

In view of the above-described problems of the prior art, it is an object of the present invention to provide an automatic coating method and an automatic coating system which can wash a rotary atomizing head from the front side thereof.

In accordance with the present invention, the above-stated object is achieved by the provision of an automatic coating method for a coating system including a working mechanism provided in a predetermined coating area, and a coating machine mounted on the working mechanism and having a rotary atomizing head to be put in high speed rotation by an air motor for atomizing paint into minute particles, the coating machine being moved by the working mechanism relative to a coating object while spraying paint thereon, the automatic coating method comprising the steps of: after stopping a coating operation by the working mechanism and the coating machine, locating a washing nozzle closely in front of the rotary atomizing head; and washing the rotary atomizing head from front side by supplying and spurting a wash fluid toward the rotary atomizing head through the washing nozzle.

With the arrangements just described, in an atomizing head washing stage subsequent to suspension of a coating operation, the washing nozzle is located closely in front of the rotary atomizing head, and a wash fluid is spurted out from the washing nozzle toward the rotary atomizing head which is put in rotation. As a result, the wash fluid is allowed to flow into and through the rotary atomizing head to wash off deposited paint therefrom.

According to the present invention, there is also provided an automatic coating system including a working mechanism provided in a predetermined coating area, and a coating machine mounted on the working mechanism and having a rotary atomizing head to be put in high speed rotation by an air motor for atomizing paint into minute particles, the automatic coating system comprising: an atomizing head washer having a washing nozzle adapted to spurt a wash fluid toward the rotary atomizing head from front side thereof, the atomizing head washer being located in the vicinity of the working mechanism and relatively movably toward and away from the rotary atomizing head.

With the arrangements just described, during a paint coating operation, the atomizing head washer is moved relatively away from the rotary atomizing head to a position which would not come into the way of the coating operation. On the other hand, at the time of an atomizing head washing operation, the atomizing head washer is moved relatively toward the rotary atomizing head and located closely on the front side of the rotary atomizing head, and then a wash fluid is spurted toward the rotary atomizing head through the washing nozzle. As a result, the rotary atomizing head is washed with the wash fluid which is supplied from the washing nozzle.

In this instance, according to one preferred form of the present invention, the rotary atomizing head of the coating machine is constituted by a main body formed in a bell-like or cylindrical shape, and a hub member which is located on the front side of said main body of the rotary atomizing head and provided with solvent outlet holes and paint outlet holes in central and peripheral portions thereof, respectively, and the washing nozzle is adapted to let the wash fluid flow into the rotary atomizing head through the solvent outlet holes and flow out through the paint outlet holes.

With the arrangements just described, in an atomizing head washing stage, the wash fluid which is spurted out through the washing nozzle is directed toward the rotary atomizing head which is in rotation. At this time, the wash fluid flows into the rotary atomizing head through solvent outlet holes in a center portion of the hub member which is barely influenced by centrifugal force of the rotary atomizing head, and flows out through paint outlet holes in peripheral portions of the hub member under the influence of the centrifugal force. As a consequence, with streams of the wash fluid flowing through the rotary atomizing head, deposited paint is washed away therefrom.

Further, according to the present invention, the atomizing head washer may be provided separately from the working mechanism. In this instance, the atomizing head washer is located in a position which would not come into the way of the coating operation by the coating machine. At the time of an atomizing head washing operation, the atomizing head washer is moved to a predetermined closely confronting position relative to the rotary atomizing head, and a wash fluid is spurted out through the washing nozzle toward the rotary atomizing head to wash the latter with the wash fluid.

In this instance, according to the present invention, the atomizing head washer may be constituted by a waste liquid collecting container located in the coating area for collecting waste liquid, and a washing nozzle provided within the waste liquid collecting container, the washing nozzle being connected to a wash fluid supply source while the waste liquid collecting container is connected to a waste liquid tank.

With the arrangements just described, at the time of washing the rotary atomizing head, the rotary atomizing head of the coating machine is put into the waste liquid collecting container of the atomizing head washer. In this state, a wash fluid is supplied from the wash fluid supply source to the washing nozzle and spurted out to wash the rotary atomizing head. Besides, the wash fluid used for washing the rotary atomizing head is collected into the waste liquid collecting container and allowed to flow down toward a waste liquid tank. Therefore, the wash fluid is prevented from scattering around to keep clean the coating area where the working mechanism is installed.

Further, according to the present invention, the atomizing head washer may be integrally mounted on the working mechanism. In this case, there will no possibility of the atomizing head washer coming into the way of the coating operation by the coating machine if it is located, for example, in front of a waiting position of the coating machine. On the other hand, at the time of washing the rotary atomizing head, the atomizing head washer is moved toward the coating machine which has been located in the waiting position, and a wash fluid is spurted out through the washing nozzle to wash the rotary atomizing head.

In this particular form of the present invention, the atomizing head washer may be constituted by a waste liquid collecting container located in the vicinity of the working mechanism within the coating area for collecting waste liquid therein, and a washing nozzle provided within the waste liquid collecting container, the washing nozzle being connected to a wash fluid supply source while the waste liquid collecting container is connected to a waste liquid tank.

With the arrangement just described, at the time of washing the rotary atomizing head, the rotary atomizing head is moved to a waiting position and then put in the waste liquid collecting container of the atomizing head washer. In this state, a wash fluid is supplied from the wash fluid supply source to the washing nozzle to wash the rotary atomizing head with the wash fluid. Used wash fluid collected in the waste liquid collecting container is allowed to flow down into the waste liquid tank. Therefore, the wash fluid is prevented from scattering around to keep clean the coating area where the working mechanism is installed.

Further, according to the present invention, the waste liquid collecting container may be provided movably toward and away from the working mechanism. In this case, the waste liquid collecting container is moved toward the working mechanism at the time of washing the rotary atomizing head, and moved to a position away from the working mechanism while the coating machine is in a paint coating operation.

DETAILED DESCRIPTION OF THE PREFERRED EMBODIMENTS

Hereafter, the present invention is described more particularly by way of its preferred embodiments with reference to FIGS. 1 through 6 of the accompanying drawings. Firstly, reference is had to FIGS. 1 to 4 which show a first embodiment of the present invention.

Figure 1:
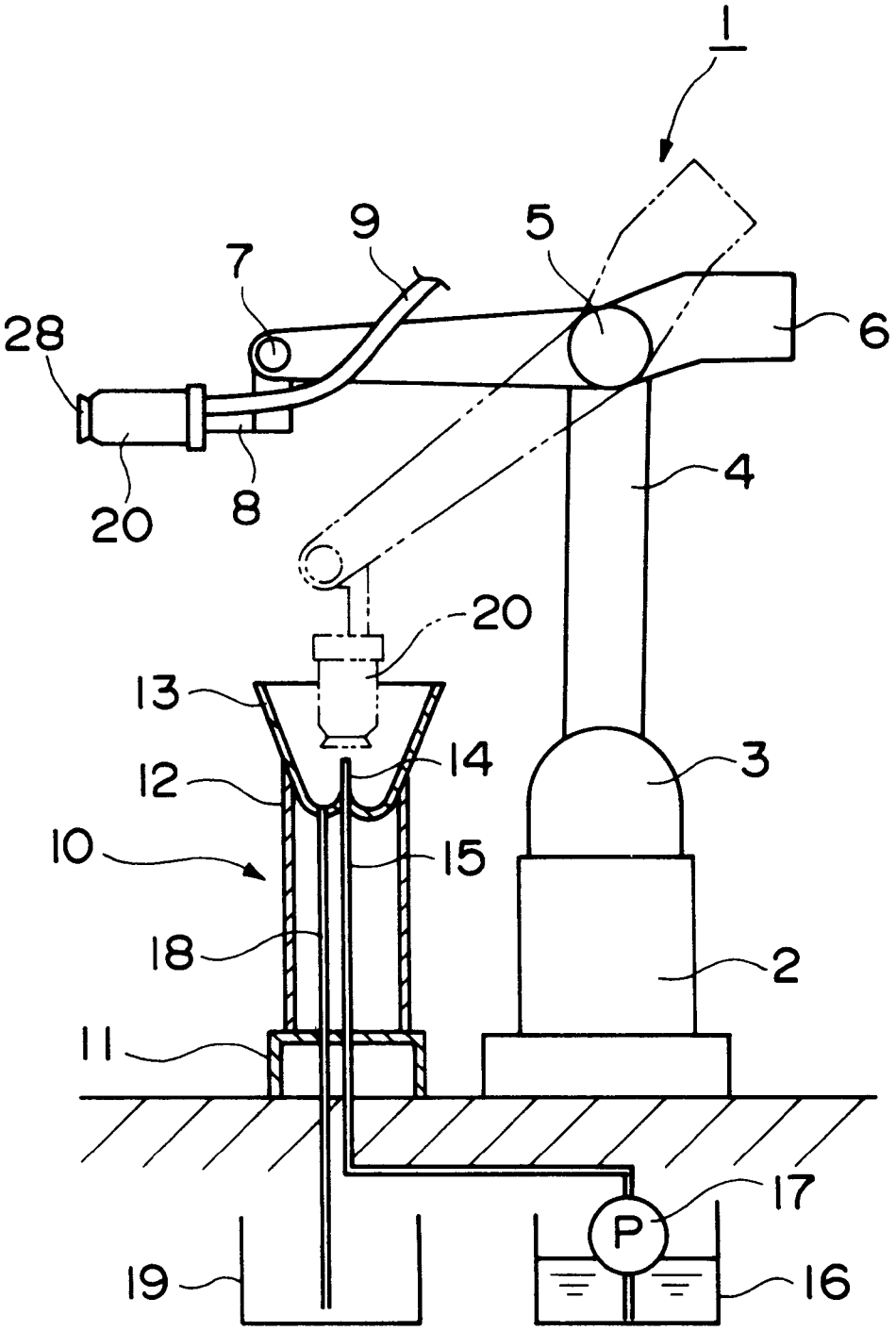
FIG. 1 is a front view of an automatic coating system which is adopted as a first embodiment of the present invention.
Figure 2:
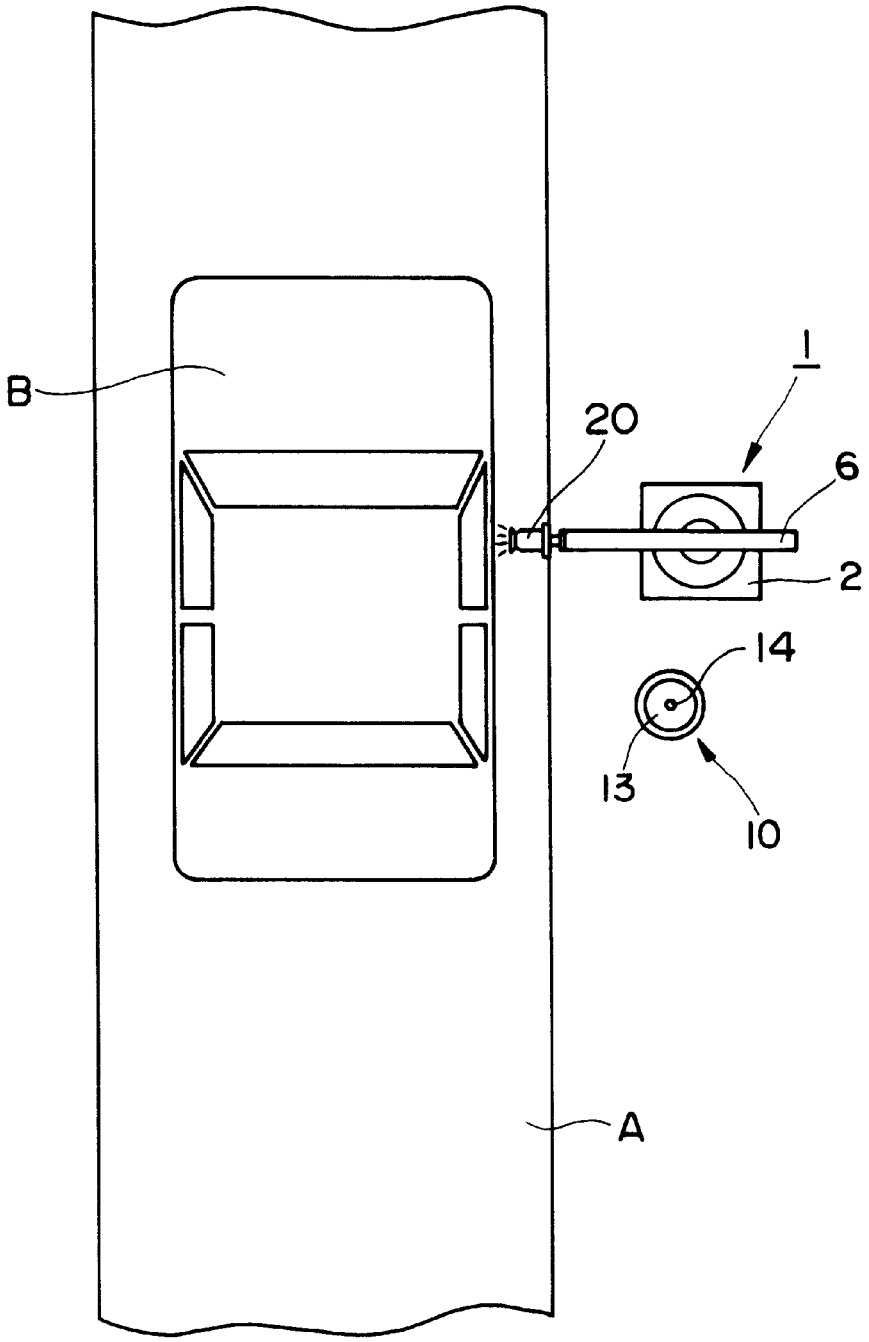
FIG. 2 is a plan view showing positional relations between the automatic coating system of the first embodiment and a conveyer.

Indicated at 1 is a coating robot which is employed as a working mechanism in the automatic coating system of the first embodiment. In this instance, as shown in FIG. 2, the coating robot 1 is largely constituted by a pedestal or base 2 which is located at one side of a conveyer A within a predetermined coating area like a coating booth, a rotary base 3 which is rotatably mounted on the pedestal 2, a support column 4 which is rockably mounted on the rotary base 3 for back and forth rocking movements thereon, an arm 6 which is pivotally supported by a coupler 5 at the upper end of the support column 4, and a wrist portion 7 which are attached to the fore end of the arm 6 with a certain degree of freedom. A coating machine 20 is detachably mounted on the wrist portion 7 by way of a support portion 8 as will be described hereinafter.

With the arrangements just described, the coating robot 1 can move the coating machine 20 in rightward and leftward directions, upward and downward direction, and forward and backward directions relative to and at a predetermined distance from a coating object, namely, a vehicle body B in this particular example. Indicated at 9 is a pipe which is connected to various passages of the coating machine 20 and to a color changing valve apparatus (not shown) which is located outside the coating area.

Denoted at 10 is a fixed type atomizing head washer which is used in this embodiment. The atomizing head washer 10 is largely constituted by a base 11 which is fixedly located within a coating area in the vicinity of the coating robot 1, a support column 12 which is erected on the base 11, a waste liquid collecting container 13 which is supported on top of the support column 12, and a washing nozzle 14 which is projected upward and centrally through the bottom of the waste liquid collecting container 13. The waste liquid collecting container 13 is formed in a cup-like shape which is open on the top side and converged toward a concavely curved bottom. In addition, as shown in FIG. 2, the atomizing head washer 10 is located in a suitable position within a coating area which would not come into the way of paint coating operations, for example, in a position at one side of the conveyer A. On the other hand, the washing nozzle 14 functions to spurt thinner toward a center portion of the rotary atomizing head 28 which will be described hereinafter. Consequently, the thinner which is spurted from the washing nozzle 14 is allowed to enter and flow into the rotary atomizing head 28, barely influenced by the centrifugal force of the rotary atomizing head 28 in high speed rotation.

Indicated at 15 is a thinner pipe which supplies thinner as a wash fluid to the washing nozzle 14. The thinner pipe 15 is connected to a thinner tank 16 at its base end and to the washing nozzle 14 at its fore end. A thinner pump 17 such as gear pump, plunger pump or the like is connected to the thinner pipe 15 on the side of the thinner tank 16. Upon actuating the thinner pump 17, a thinner (or a wash fluid) in the thinner tank 16 is spurted out through the washing nozzle 14.

Denoted at 18 is a waste liquid drain pipe or tube which is connected to the lowermost bottom portion of the waste liquid collecting container 13 at one end and to the waste liquid tank 19 at the other end thereof. This waste liquid drain pipe 18 provides a flow passage to the waste liquid tank 19 for the waste liquid consisting of thinner and paint collected in the waste liquid collecting container 19.

Figure 3:
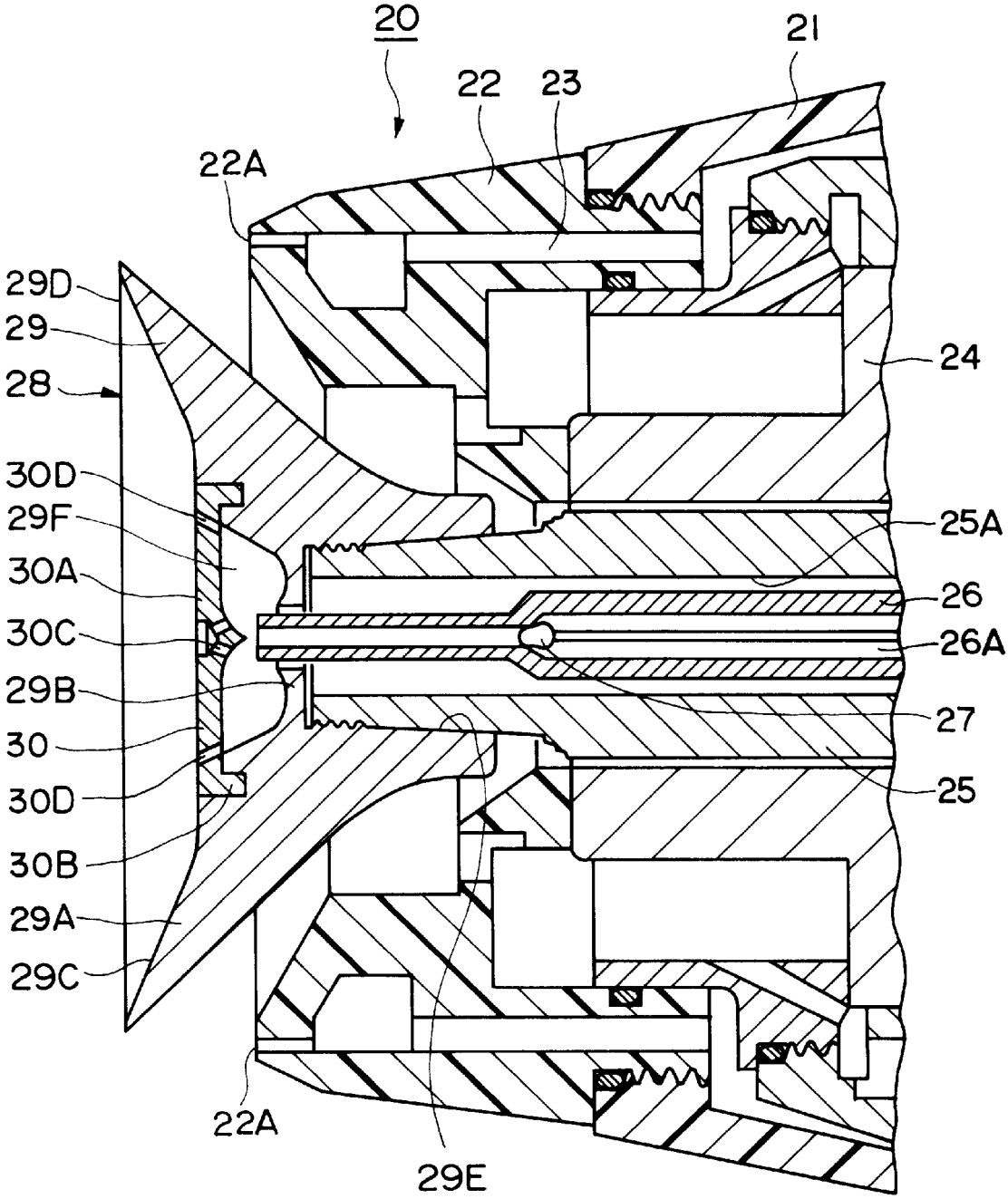
FIG. 3 is an enlarged sectional view showing major components of a rotary atomizing head of a coating machine to be mounted on a coating robot.
Figure 4:
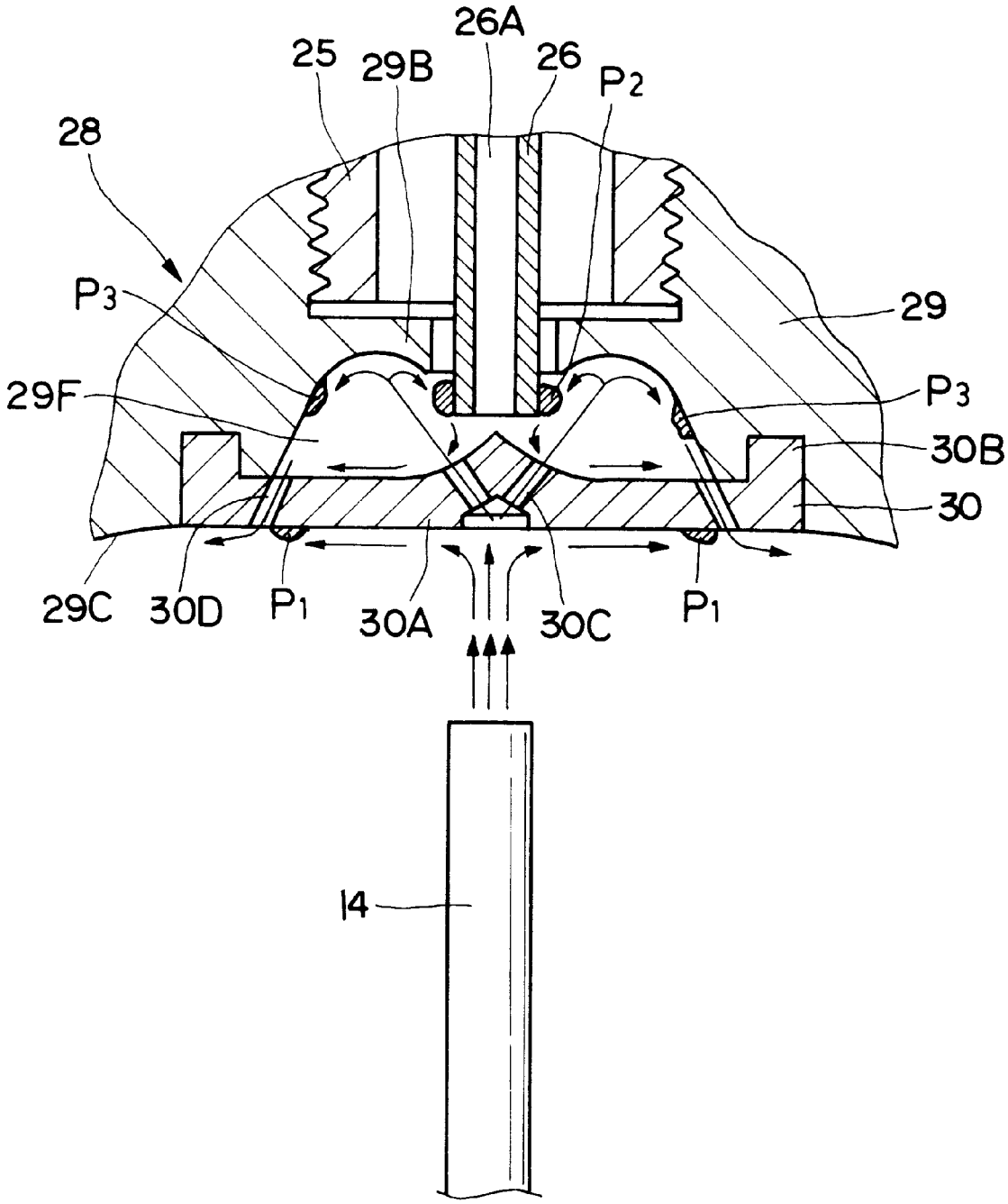
FIG. 4 is a schematic illustration showing the manner in which a wash fluid, supplied from a wash nozzle, flows on and in the rotary atomizing head.

Indicated at 20 is a coating machine which is used in the present embodiment. The coating machine 20 can be turned in upward, downward, rightward and leftward directions by pivotal movements of the support members 8 in the wrist portion 7 of the coating robot 1. In construction, the coating machine 20 is arranged as shown in FIG. 3.

In that figure, indicated at 21 is a housing which defines the outer profile of the coating machine 20. The housing 21 is formed of an insulating synthetic resin material in a cylindrical shape. Provided in the housing 21 is an air motor 24 which will be described hereinafter, along with a shaping air ring 22 which is located on the front side of the housing 21. In this instance, similarly to the housing 21, the shaping air ring 22 is formed of an insulating synthetic resin material in the shape of a covered cylinder with stepped peripheral walls. Opened in a front end face of the shaping air ring 22 are a multitude of shaping air outlet holes 22A which are arranged annularly or circularly at suitable intervals. Shaping air passages 23 are provided in the housing 21 and shaping air ring 22 to supply shaping air to the air outlet holes 22A.

Indicated at 24 is an air motor which is mounted within the housing 21. The air motor 24 is formed of a conductive metallic material in a hollow cylindrical shape and internally provided with an air turbine and air bearings (both of which are not shown in the drawings) for driving a rotational shaft 25 which will be described hereinafter. Further, the air motor 24 is applied with a high voltage from a high voltage generator (not shown).

Denoted at 25 is the above-mentioned rotational shaft which is formed of a conductive metallic material in a hollow cylindrical shape and internally provided with a bore 25A. The rotational shaft 25 is axially passed through and supported in the air motor 24 for high speed rotation therein. Further, the rotational shaft 25 has its base end portion fitted in the air turbine (not shown) of the air motor 24 and has its fore end projected on the front side of the air motor 24.

Designated at 26 is a feed tube which is extended axially through the bore 25A of the rotational shaft 25. This feed tube 26 is constituted by a single tube of a conductive metallic material, internally defining a paint passage 26A which is connected to a color changing valve apparatus through a paint pipe (both of which are not shown in the drawings). Provided within the length of the feed tube 26 is a valve member 27 of a paint valve (not shown) which functions to turn on and off the supply of paint or thinner. Further, connected to the base end of the feed tube 26 is a waste liquid drain passage which is in communication with a waste liquid tank through a waste drain valve (both of which are not shown in the drawings). On the other hand, the fore end of the feed tube 26 is projected out of the rotational shaft 25 and extended into the rotary atomizing head 28.

Indicated at 28 is a bell type rotary atomizing head, which is mounted on the rotational shaft 25 on the front side of the shaping air ring 22. The rotary atomizing head 28 is constituted by a main body 29 and a hub member 30.

In this instance, the main body 29 of the rotary atomizing head 28 is constituted by a bell cup portion 29A which is formed of a conductive metallic material in a bell-like shape spreading in the forward direction, an annular partition wall 29B which is projected radially inward from the bell cup portion 29A behind the hub member 30, a paint spreading surface 29C which is formed on a front face of the bell cup portion 29A on the front side of the hub member 30 for spreading paint into a thin film, paint releasing edges 29D which are provided at and around the front end of the bell cup portion 29A for releasing as liquid threads the thin film of paint from the paint spreading surface 29C, a mounting hole 29E which is bored axially into a smaller diameter end of the bell cup 29A for fitting engagement with a fore end portion of the rotational shaft 25, and a paint reservoir 29F which is defined between the front side of the annular partition wall 29B and the back side of the hub member 30.

The hub member 30 is mounted centrally on the inner peripheral side of the bell cup 29A by fitting engagement with the latter. Similarly to the main body 29 of the rotary atomizing head, the hub member 30 is formed of a conductive metallic material. In this instance, the hub member 30 is constituted by a circular plate portion 30A which closes the front side of the bell cup 29A, and an annular rim portion 30B which is formed along the outer periphery of the circular plate portion 30A for fitting engagement with the front face of the main body 29 of the atomizing head. A plural number of solvent outlet holes 30C (e.g., four solvent outlet holes) are bored in a center region of the circular plate portion 30A of the hub member 30 to let a supply of thinner from the feed tube 26 flow out onto the front surface at the time of a washing operation (although only two of the solvent outlet holes are shown in the drawings). Besides, a plural number of paint outlet holes 30D are bored in radially outer portions of the circular plate portion 30A of the hub member 30, thereby guiding paint or thinner from the feed tube onto the paint spreading surface 29C on the main body 29 of the atomizing head.

Further, the rotary atomizing head 28 is mounted on the rotational shaft 25 by fitted and threaded engagement with a fore end portion of the rotational shaft 25 which is received in the mounting bore 29E of the main body 29 of the atomizing head. When the rotary atomizing head 28 is mounted on the rotational shaft 25, the fore end of the feed tube 26 is projected forward of the annular partition wall 29B on the main body 29 of the atomizing head.

Having the construction as described above, the automatic coating system according to the present embodiment operates in the manner as follows.

In case of a paint coating operation using the coating machine 20 for coating an article like a vehicle body, for example, the coating machine 20 is moved by a coating robot 1 to shift its paint spraying position, keeping a predetermined distance from the vehicle body B while coating a paint on the vehicle body B.

More particularly, while applying a high voltage to the coating machine 20, air is supplied to the air motor 24 to put the rotary atomizing head 20 (i.e., the rotational shaft 25) in high speed rotation. In this state, the valve body 27 of the paint valve is opened so that the paint from the color changing valve apparatus is allowed to flow into the paint passage 26A of the feed tube 26 and spouted toward the rotary atomizing head 28. As a consequence, the paint which is fed to the rotary atomizing head 28 is released from the paint releasing edges 29D as charged paint particles. Whereupon, charged paint particles are shaped into a suitable spray pattern by the action of shaping air which is spurted out through the respective shaping air outlet holes 22A, and urged to fly toward the vehicle body along an electrostatic field which is formed between the rotary atomizing head and the vehicle body B, which is connected to earth, and deposit on the vehicle body B. By controlling the operation of the coating robot 1 in relation with the operation of the coating machine 20 in this manner, the coating machine 20 is moved along the contours of the vehicle body B by the coating robot 1 to carry out an automatic coating operation.

Now, for changing the paint to a new or next color, it is necessary to wash off previous color in or on various parts of the machine, including the paint supply line from the color changing valve apparatus to the rotary atomizing head 28, the paint passage 26A of the feed tube 26, and the rotary atomizing head 28. For this purpose, the coating robot 1 is operated to shift the coating machine 20 to a predetermined position, for example, as indicated by two-dot chain line in FIG. 1, and the rotary atomizing head 28 which is in high speed rotation is relatively moved to the proximity of the washing nozzle 14.

In the first place, the paint line from the color changing valve apparatus to the rotary atomizing head 28 is washed in the following manner. In this case, by opening the drain valve which is located on the upstream side of the feed tube 26, a waste liquid drain passage is established from the paint feed pipe to the waste tank via the waste liquid drain valve and the waste liquid drain passage. In this state, thinner and air are alternately supplied from the color changing valve apparatus to flush the paint line between the color changing valve apparatus and the paint feed pipe, and waste liquid is collected in the waste tank through the above-mentioned waste liquid drain passage.

In the next place, residues of a previous color in the paint passage 26A of the feed tube 26 are washed off in the manner as follows. For this purpose, the waste drain valve is closed to shut up the passage to the waste liquid tank. Consequently, the thinner from the color changing valve apparatus is fed to the feed tube 26. This thinner flows out into the waste liquid collecting container 13 via the paint feed pipe, the paint passage 26A in the feed tube 26, the rotary atomizing head 28, and the respective solvent outlet holes 30C and paint outlet holes 30D of the hub member 30, thereby collecting the thinner into the waste liquid tank 19. In this stage, it is not necessary to clean the rotary atomizing head 28 in high speed rotation, which will be washed clean in a succeeding atomizing head washing stage. Accordingly, in this stage, it suffice to consume only a small amount of thinner which is necessary for washing off the previous color remaining in the paint passage 26A of the feed tube 26.

In the next stage, the rotary atomizing head 28 is washed in the manner as follows. In this atomizing head washing stage, the thinner pump 17 is actuated to spurt thinner from the washing nozzle 14 of the atomizing head washer 10 toward the front side of the rotary atomizing head 28 which is in high speed rotation. More particularly, as indicated by arrows in FIG. 4, thinner is spurted from the washing nozzle 14 toward the center of the hub member 30 which is less influenced by the centrifugal force resulting from high speed rotation of the rotary atomizing head 28. By the centrifugal force of the rotary atomizing head 28, the supplied thinner is divided into two different types of streams, i.e., streams which move along the surface of the hub member 30, and streams which flow into the rotary atomizing head through the respective solvent outlet holes 30C and then come out through the respective paint outlet holes 30D.

The thinner streams along the surface of the hub member 30 are urged to flow from radially inner to radially outward directions of the hub member 30 by the centrifugal force of the rotary atomizing head 28, thereby washing off deposited paint $P_1$ from the surface of the hub member.

Besides, the other thinner streams, which have entered the paint reservoir 29F on the inner side of the hub member 30 through the solvent outlet holes 30C, are separated into streams along the inner wall surface of the annular partition wall 29B and streams along the back side of the hub member 30. Paint $P_2$ which had deposited on the outer periphery of a fore end portion of the feed tube 26 is washed off by the thinner streams along the inner wall surface of the annular partition wall 29B, along with paint $P_3$ which had deposited on the surfaces between the annular partition wall 29B and the paint outlet holes 30D of the main body 29 under the influence of the centrifugal force on the rotary atomizing head 28. On the other hand, paint which has deposited on the back side of the hub member 30 is washed off by the back side thinner streams.

Further, the thinner streams along the surfaces of the hub member 30 as well as the thinner streams coming out through the paint outlet holes 30D of the rotary atomizing head after entrance through the solvent outlet holes 30C are collected into the waste liquid collecting container 13. The collected thinner is allowed to flow down through the waste liquid pipe 18 into the waste liquid tank 19.

After washing the paint line, the feed tube 26 and the rotary atomizing head 28 in this manner, paint of a new color is fed to the coating machine 20 from the color changing valve apparatus in preparation for a nest cycle of coating operation.

Thus, according to the automatic coating system of the first embodiment as described above, when changing the paint color, the front end of the coating machine 20, which is mounted on the coating robot 1, is put into the waste liquid collecting container 13, and at the same time thinner is spurted from the washing nozzle 14 against the front side of the rotary atomizing head 28, thereby facilitating the washing operation on the rotary atomizing head 28.

In this regard, in the case of prior art machines, it has been necessary to wash all of the paint pipe, feed tube and rotary atomizing head with thinner which is supplied from a color changing valve apparatus each time before changing the paint color. In contrast, according to the present embodiment of the invention, the rotary atomizing head 28 is washed by means of the washing nozzle 14 of the atomizing head washer 10 separately from washing operations for the paint pipe and feed tube 26. Consequently, the consumption of thinner to be used for washing the paint line can be reduced to an amount which is necessary for washing the paint line and feed tube 26 alone, permitting to cut the running cost to a significant degree.

Further, according to the present embodiment having the atomizing head washer 10 located in the vicinity of the coating robot 1 for washing exclusively the rotary atomizing head 28, the feed tube 26 of the coating machine 20 can be constituted by one and single tube. Therefore, the feed tube is not required to be a double wall tube internally defining a paint passage along with a front washing thinner passage as in Japanese Utility Model Laid Open No. H2-37766 mentioned hereinbefore. Besides, the present embodiment makes it possible to omit the front washing thinner passage from the feed tube, as well as the front washing valve, thinner feed pipe and thinner source which are necessarily connected to the front washing thinner passage, thereby contributing to simplify the construction of the coating machine unit.

Similar effects can be obtained even if the coating machine 20, which is mounted on the coating robot in the above-described embodiment, is replaced by a coating machine having a number of bundled paint feed tubes respectively for various colors as in Japanese Patent Laid-Open No. H6-134354 mentioned hereinbefore. Even in this case, it becomes possible to simplify the construction of the coating machine by omitting not only the wash feed tube in the bundle of a plural number of feed tubes but also the front washing valve, front washing thinner feed pipe and front washing thinner source.

Further, in the case of the present embodiment which can obviate the front washing thinner passage (or the wash feed tube), there is no possibility of an applied high voltage flowing to the front washing thinner source via the thinner in the front washing thinner passage (or the wash feed tube). It follows that the thinner to be used for the washing operation can be selected irrespective of electrical resistance, and simply from products which have satisfactory properties in washing capacity. Besides, a substantial cut in cost can be realized by a reduction of thinner consumption in washing the paint line and the rotary atomizing head 28.

Furthermore, at the time of a washing operation, the front end of the coating machine 20 is automatically put into the waste liquid collecting container 13 by operation of the coating robot 1, and spent thinner or waste liquid resulting from the washing operation can be collected into the waste liquid tank 19 through the waste liquid collecting container 13 and the waste liquid pipe 18, thereby preventing the thinner from scattering around in the coating area and thereby keeping the coating area clean.

Figure 5:
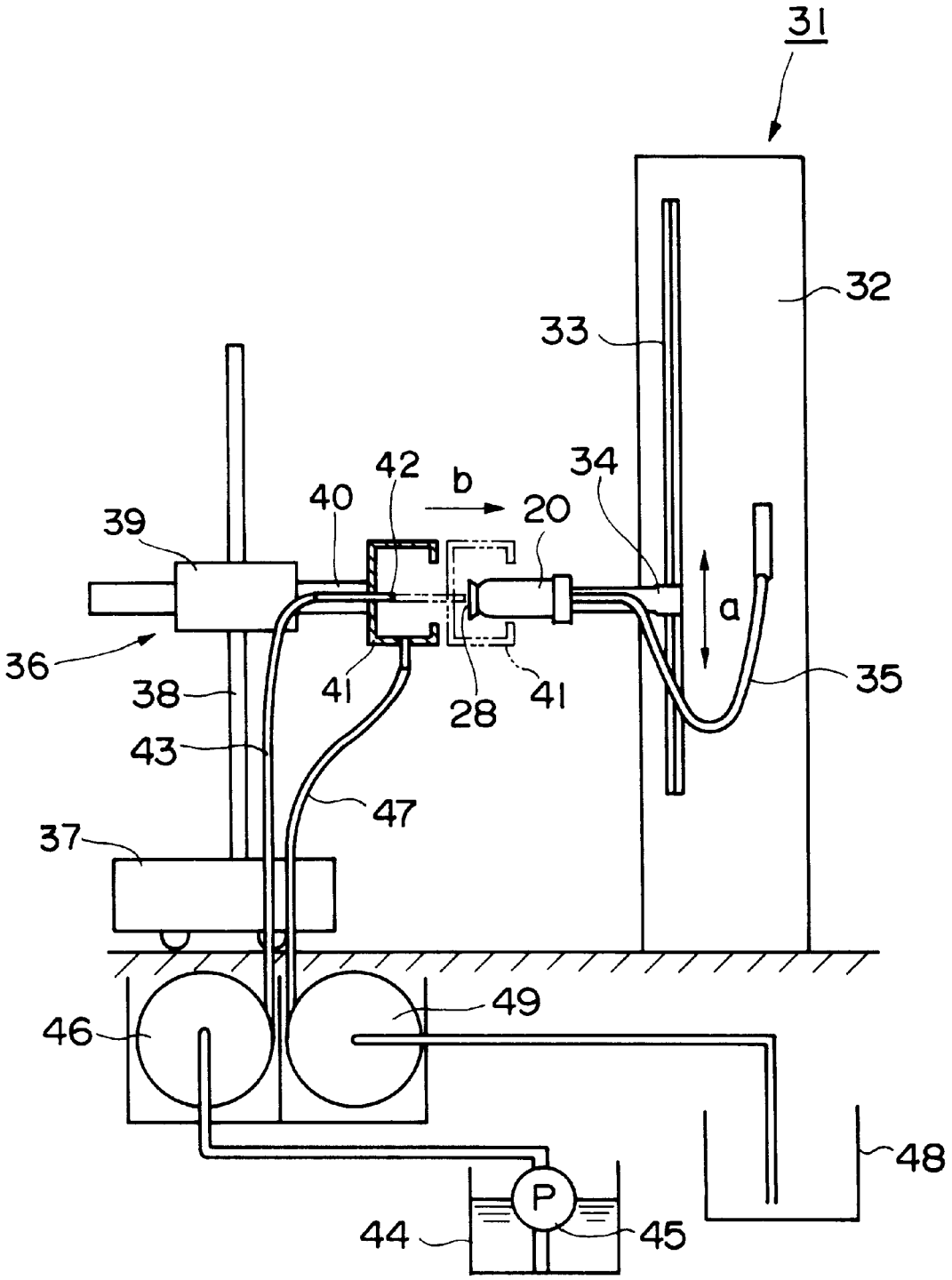
FIG. 5 is a front view of an automatic coating system which is adopted as a second embodiment of the present invention.

Referring now to FIG. 5, there is shown a second embodiment of the present invention, with features in that the coating machine is mounted on a reciprocator which is employed as a working mechanism, and in that the washing nozzle is mounted on an atomizing head washer separately from the reciprocator. In the following description of the second embodiment, the component parts which are common with the foregoing first embodiment are simply designated by common reference numerals or characters to avoid repetitions of same explanations.

Indicated at 31 is a side type reciprocator which has been adopted as a working mechanism in the automatic coating system of the present embodiment. In this instance, the reciprocator 31 is mainly constituted by a fixed casing 32 which is located within a coating area and at one side of a conveyer (not shown), which transfers coating articles into and out of the coating area, a vertical slide slot 33 which is formed on one side of the fixed casing 32, and a moving arm 34 which is reciprocated up and down within the slide slot 33 as indicated by arrows a. A coating machine 20 similar to the one in the foregoing first embodiment is mounted on a fore end portion of the moving arm 34. Side surfaces of a vehicle body or the like are coated by moving the arm 34 in the directions of arrows a. Indicated at 35 is a pipe which is connected between the coating machine 20 and a color changing valve apparatus (not shown) which is located outside the coating area.

Denoted at 36 is a movable type atomizing head washer which is employed in the present embodiment. The atomizing head washer 36 is provided separately from the reciprocator 31 and located within the coating area. In this instance, the atomizing head washer 36 is constituted by a carriage 37 which is movable back and forth and to the right and left within the coating area, a post 38 which is erected on the carriage 37, an arm moving mechanism 39 which is slidably mounted on the post 38 for upward and downward movements, a support arm 40 which is moved back and forth (in the directions of arrow b), a waste liquid collecting container 41 which is located in a front end position on the arm 40, and a washing nozzle 42 which is mounted within the waste liquid collecting container 41 and projected forward from a deep center position toward a front opening of the waste liquid collecting container 41. The waste liquid collecting container 41 is formed in a cylindrical shape which is closed on the rear side and provided with an opening on the front side thereof. Connected to the bottom or lower side of the waste liquid collecting container 41 is a waste liquid pipe 47 which will be described hereinafter. The atomizing head washer 36 is located in a position which would not come into the way of the coating machine during coating operations.

Indicated at 43 is a thinner pipe or tube which supplies a wash fluid such as thinner to the washing nozzle 42. The thinner pipe 43 is connected to the washing nozzle 42 at its fore end and connected to a thinner tank 44 at its base end. At the end on the side of the thinner tank 44, a thinner pump 45 is connected to the thinner pipe 43. Upon actuating the thinner pump 45, the thinner in the tank 44 is pumped up therefrom and spurted out as a wash fluid from the tip end of the wash nozzle 42. Further, a tube take-up reel 46 is provided at a halfway point thereby to reel up or reel out the thinner tube 43, for reducing or increasing the length of the thinner tube 43 according to movements of the atomizing head washer 36.

Denoted at 47 is a waste liquid tube which has one end thereof connected to a lowermost portion of the waste liquid collecting container 41 and the other end connected to the waste liquid tank 48. The waste liquid, including paint and thinner, which has been collected into the waste liquid collecting container 41 is allowed to flow down into the waste liquid tank 48 through the waste tube 47. Further, a tube take-up reel 49 is provided at a halfway point to reel up or reel out the waste liquid tube 47, thereby reducing or increasing the length of the waste liquid tube 47 according to movements of the atomizing head washer 36.

With arrangements as described above, the coating system of the second embodiment operates in the manner as follows.

In this instance, charged paint particles which are released from the rotary atomizing head 28 of the coating machine 20 are caused to fly toward and deposit on a coating object like a vehicle body, traveling along an electrostatic field which is formed between the rotary atomizing head 28 and the vehicle body which is connected to earth. In coating side surfaces of the vehicle body, the coating machine 20 is moved by the reciprocator 31 up and down (in the directions of arrow a) relative to the vehicle body which is being transferred by the conveyer.

Now, when changing the paint color, the arm 34 of the reciprocator 31 is stopped at a predetermined position, and the atomizing head washer 36, which is of a movable type in this case, is moved to the proximity of the reciprocator 31. At this time, the thinner tube 46 and the waste liquid tube 47 on the reels 46 and 49 are reeled out or reeled up according to the movement of the atomizing head washer 30.

Then, the height of the waste liquid collecting container 41 is adjusted to the same level as the coating machine 20 by vertically adjusting the position of the support arm 40 through the arm moving mechanism 39 of the atomizing head washer 36. Again through the arm moving mechanism 39, the support arm 40 is moved in the direction of arrow b to locate the waste liquid collecting container 41 in the position indicated by two-dot chain line, so that a fore end portion of the coating machine 20 is received in the waste liquid collecting container 41. At this time, the fore end of the washing nozzle 42 is advanced along with the waste liquid collecting container 41 toward and into a closely confronting position relative to the rotary atomizing head 28.

In this state, firstly thinner is supplied from a color changing valve apparatus to wash the paint line substantially in the same manner as described in the foregoing first embodiment. In the next place, through the washing nozzle 42 of the atomizing head washer 36, thinner is supplied to the front side of the rotary atomizing head 28, which is in high speed rotation, to wash off deposited paint therefrom.

Thus, similarly to the above-described first embodiment, this embodiment makes it possible to obviate the washing thinner passage as used in the feed tube on prior art coating machines, contributing to simplify the construction of the coating machine.

In addition, since the rotary atomizing head 28 is washed separately from the paint line, it becomes possible to reduce the consumption of thinner or other wash fluid and therefore to cut the running cost.

Further, during a washing operation, the fore end of the coating machine 20 which is mounted on the reciprocator 31 is put in the waste liquid collecting container 41. Accordingly, the waste liquid like waste thinner which occurs during a washing operation is collected into the waste liquid tank 48 through the waste liquid collecting container 41 and waste liquid tube 47, thereby preventing thinner from scattering around within the coating area and keeping the coating area clean.

Figure 6:
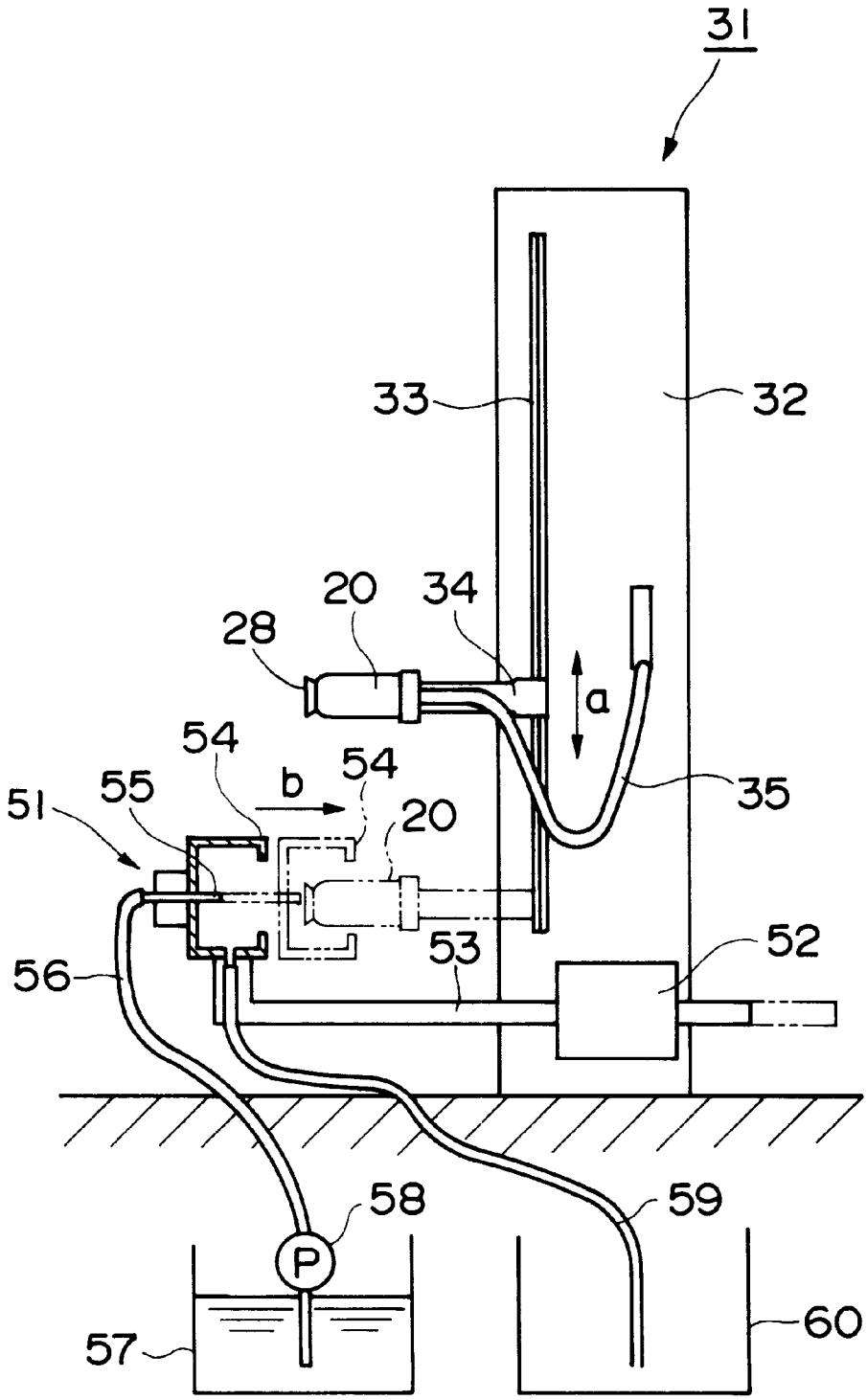
FIG. 6 is a front view of an automatic coating system which is adopted as a third embodiment of the present invention.

Shown in FIG. 6 is a third embodiment of the present invention, with features in that, in addition to a coating machine 20, a washing nozzle is mounted on a reciprocator 31 in a position close to the coating machine 20. In the following description of the third embodiment, the component parts which are common with the foregoing first and second embodiments are designated by common reference numerals or characters to avoid repetition of same explanations.

Indicated at 51 is an atomizing head washer which is adopted in the present embodiment. The atomizing head washer 51 is located in a position which corresponds to a lowermost waiting position of an arm 34 which is moved along a sliding slot 33 of a reciprocator 31. In this instance, the atomizing head washer 51 is mainly constituted by an arm moving mechanism 52 which is fixedly mounted in a lowermost portion of a fixed casing 32, a support arm 53 which is moved by the arm moving mechanism 52 and upturned at its fore end, a waste liquid collecting container 54 which is formed on the upturned fore end of the support arm 53 and provided with an opening on a lateral side facing toward the reciprocator, and a washing nozzle 55 which is mounted in the waste liquid collecting container 54 and projected forward toward the opening from a deep center position in the waste liquid collecting container 54.

Denoted at 56 is a thinner tube for supplying a wash fluid like thinner to the washing nozzle 55. The base end of the thinner tube 56 is connected to a thinner tank 57, while its fore end is connected to the washing nozzle 55. On the side of the thinner tank 57, a thinner pump 58 is connected to the thinner tube 56 so that, upon actuating the thinner pump 58, thinner is pumped up from the thinner tank 57 and spurted out through a nozzle hole at the fore end of the washing nozzle 55.

Indicated at 59 is a waste liquid tube which has one end thereof connected to a lowermost portion of the waste liquid collecting container 54 and the other end connected to the waste liquid tank 60. The waste liquid containing spent thinner and paint, which has been collected in the waste liquid collecting container 54, is allowed to flow down into the waste liquid tank 60 through the liquid tube 59.

In the case of the atomizing head washer 51 with the arrangements just described, the rotary atomizing head 28 is moved into the lowermost waiting position by the moving arm 34 in an atomizing head washing stage, and then the arm 53 is moved in the direction of arrow b. As a result, the coating machine 20 and the washing nozzle 55 are shifted into the positions indicated by two-dot chain line, and the fore end of the washing nozzle 55 is located in closely confronting relation with the rotary atomizing head 28. Then, thinner is spurted toward the front side of the rotary atomizing head 28 from the washing nozzle 55 to wash the rotary atomizing head 28.

In the foregoing embodiments, the feed tube 26 is used for the supply of paint to the coating machine 20. However, it is to be understood that the present invention is not restricted to this particular form of coating machine and can also be applied to a cartridge-type coating machine which is arranged to supply paint from cartridge-type paint tanks. In such a case, the rotary atomizing head is washed each time when a paint tank is replaced for a change of color.

Further, the present invention is not limited to the particular combinations shown in the above-described embodiments, i.e., the combination of the coating robot 1 and the fixed type atomizing head washer 10 in the first embodiment, the combination of the reciprocator 31 and the movable type atomizing head washer 36 in the second embodiment, and the combination of the reciprocator 31 and the movable type atomizing head washer 51 which is provided on the reciprocator. Of course, the present invention can be similarly realized by means of a combination of the coating robot 1 and the movable type atomizing head washer 36.

Further, although a gear pump or a plunger pump is employed as the thinner pump 17 (45, 58) in the foregoing embodiments for spurting thinner through the washing nozzle 14 (42, 55), the present invention is not limited to the particular arrangements shown. For example, in place of a gear or plunger pump, there may be employed a pressure tank which is arranged to push thinner forward under pressure of compressed air.

Alternatively, if desired, the thinner pump 17 (45, 58) may be abolished by connecting the wash tube 15 (43, 56) to a thinner circulation line.

Further, although the present invention has been described in the foregoing embodiments by way of a direct charging type coating machine in which a high voltage is applied to the rotary atomizing head for electrically charging atomized paint particles which are released from the rotary atomizing head 28. However, the present invention is not limited to coating machines of this sort but similarly applicable to an indirect charging type coating machine in which a corona discharge area is formed in front of a rotary atomizing head to apply a high voltage to atomized paint particles released from the rotary atomizing head, or to a coating machine with a non-electrostatic type rotary atomizing head.

Moreover, needless to say, the coating machine may have a tubular or cup-shaped rotary atomizing head in place of the bell type rotary atomizing head in each one of the above-described embodiments.

As explained in detail in the foregoing description, the automatic coating method according to the present invention comprises an atomizing head washing step in which, after stopping a coating operation by a coating machine and a working mechanism, a washing nozzle is located in a confronting position relative to a rotary atomizing head to spurt a wash fluid toward the front side of the rotary atomizing head. Being supplied from the front side, the wash fluid is allowed to enter and flow through interior passages of the rotary atomizing head, thereby making it possible to wash off deposited paint therefrom in a reliable manner and with a reduced amount of wash fluid to realize a substantial reduction in running cost.

The automatic coating machine according to the present invention comprises an atomizing head washer which is provided with a washing nozzle and located in the proximity of a working mechanism movably toward and away from a rotary atomizing head, for washing the rotary atomizing head with a wash fluid which is supplied through the washing nozzle of the atomizing head washer. Being supplied from the front side, the wash fluid is allowed to enter and flow through interior passages of the rotary atomizing head, thereby making it possible to wash off deposited paint therefrom reliably with a reduced amount of wash fluid. Besides, it contributes to simplify the construction of the coating machine since there is no necessity for providing a washing mechanism for the rotary atomizing head on the part of the coating machine.

What is claimed is:

1. An automatic coating method for a coating system including a working mechanism provided in a predetermined coating area and a coating machine mounted on said working mechanism and having a rotary atomizing head to be put in high speed rotation by an air motor for atomization of a paint, said rotary atomizing head having a main body of any one of bell-shaped and cylindrically-shaped and a hub member being mounted on the front side of said main body of said rotary atomizing head in such a way as to define a paint reservoir therebetween and being provided with solvent outlet holes and paint outlet holes in central and peripheral portions thereof, respectively, and said coating machine being moved by said working mechanism relative to a coating object while spraying paint thereon, said method comprising the steps of:

after stopping a coating operation by said working mechanism and said coating machine, positioning a washing nozzle closely in front of said rotary atomizing head; and washing said rotary atomizing head from a front side thereof by supplying a wash fluid toward a center portion on the front side of said hub member to let said wash fluid flow into said paint reservoir through said solvent outlet holes and flow out through said paint outlet holes.

2. An automatic coating system including a working mechanism provided in a predetermined coating area, and a coating machine mounted on said working mechanism and having a rotary atomizing head to be put in high speed rotation by an air motor for atomization of a paint into minute particles, said automatic coating system comprising:

an atomizing head washer having a washing nozzle adapted to spurt a wash fluid toward a center portion of a front side of said rotary atomizing head, said atomizing head washer being located near enough to said working mechanism so that said rotary atomizing head almost comes into contact with said washing nozzle of said atomizing head washer when said working mechanism moves said rotary atomizing head toward said atomizing head washer, wherein said rotary atomizing head of said coating machine is constituted by a main body formed so as to be any one of bell-shaped and cylindrically-shaped, a hub member is mounted on the front side of said main body of said rotary atomizing head in such a way as to define a paint reservoir therebetween and provided with solvent outlet holes and paint outlet holes in central and peripheral portions thereof, respectively, and said washing nozzle of said atomizing head washer is adapted to supply said wash fluid to a center portion on the front side of said hub member to let said wash fluid flow into said paint reservoir through said solvent outlet holes and flow out through said paint outlet holes.

3. The automatic coating system as defined in claim 2, wherein said atomizing head washer is provided separately from said working mechanism.

4. An automatic coating system as defined in claim 3, wherein said atomizing head washer is constituted by a waste liquid collecting container located in said coating area for collecting waste liquid, and a washing nozzle provided within said waste liquid collecting container, said washing nozzle being connected to a wash fluid supply source, and said waste liquid collecting container being connected to a waste liquid tank.

5. An automatic coating system as defined in claim 2, wherein said atomizing head washer is integrally mounted on said working mechanism.

6. The automatic coating system as defined in claim 5, wherein said atomizing head washer is constituted by a waste liquid collecting container located near enough to said working mechanism within said coating area so that when said coating machine almost comes into contact with said washing nozzle, waste liquid can be collected in said waste liquid collecting container, wherein said washing nozzle is provided within said waste liquid collecting container, said washing nozzle being connected to a wash fluid supply source, and said waste liquid collecting container being connected to a waste liquid tank.

7. An automatic coating system as defined in claim 6, wherein said waste liquid collecting container is movable toward and away from said working mechanism.

8. An automatic coating system including a working mechanism provided in a predetermined coating area, and a coating machine mounted on said working mechanism and having a rotary atomizing head to be put in high speed rotation by an air motor for atomization of a paint into minute particles, said automatic coating system comprising:

said rotary atomizing head of said coating machine has a main body of any one of bell-shaped and cylindrically-shaped, and a hub member mounted on the front side of said main body of said rotary atomizing head in such a way as to define a paint reservoir therebetween and provided with solvent outlet holes and paint outlet holes in central and peripheral portions thereof, respectively; and an atomizing head washer located near enough to said coating machine so that said rotary atomizing head almost comes into contact with a washing nozzle of said atomizing head washer when said working mechanism moves said rotary atomizing head toward said atomizing head washer, said washing nozzle adapted to supply a wash fluid toward a center portion on the front side of said hub member of said rotary atomizing head, letting said wash fluid flow into said paint reservoir through said solvent outlet holes and flow out through said paint outlet holes, said atomizing head washer being movable relatively toward and away from said rotary atomizing head.

* * * * *